US012134497B2

(12) United States Patent
Chen et al.

(10) Patent No.: US 12,134,497 B2
(45) Date of Patent: Nov. 5, 2024

(54) FOOD PACKAGING BODY AND A COMBINATION PACKAGING BODY INCLUDING THE SAME

(71) Applicant: MARS, INCORPORATED, McLean, VA (US)

(72) Inventors: Benjamin Chen, Huairou (CN); Shengchuan Li, Guangzhou (CN)

(73) Assignee: Mars, Incorporated, McLean, VA (US)

( * ) Notice: Subject to any disclaimer, the term of this patent is extended or adjusted under 35 U.S.C. 154(b) by 126 days.

(21) Appl. No.: 17/291,191

(22) PCT Filed: Nov. 8, 2019

(86) PCT No.: PCT/IB2019/059630

§ 371 (c)(1),
(2) Date: May 4, 2021

(87) PCT Pub. No.: WO2020/095273

PCT Pub. Date: May 14, 2020

(65) Prior Publication Data

US 2022/0063859 A1 Mar. 3, 2022

(30) Foreign Application Priority Data

Nov. 10, 2018 (CN) ..... 201821871878.2

(51) Int. Cl.
*B65D 1/36* (2006.01)
*B65D 21/02* (2006.01)

(52) U.S. Cl.
CPC ..... *B65D 1/36* (2013.01); *B65D 21/0217* (2013.01)

(58) Field of Classification Search
CPC ..... B65D 1/36; B65D 21/0217; B65D 85/60; B65D 85/36; B65D 65/02
See application file for complete search history.

(56) References Cited

U.S. PATENT DOCUMENTS 3,121,507 A * 2/1964 Weiss ..... B65D 1/36 229/116.2
3,552,595 A 1/1971 Gerner
(Continued)

FOREIGN PATENT DOCUMENTS

DE 1122436 * 1/1962
DE 29908797 U1 * 11/1999 ..... B65D 5/2004
(Continued)

*Primary Examiner* — Anthony D Stashick
*Assistant Examiner* — Blaine G Neway

(57) ABSTRACT

The present disclosure provides a food packaging body including a tray and a lid located above the tray, and the tray has two or more downward recessed cavities, wherein the lid has upward protruding cavities which are less than the downward recessed cavities, and each of the upward protruding cavities is corresponding to the position of a downward recessed cavity. The present disclosure provides a combination packaging body including an outer packaging component, and at least one food packaging body according to the present disclosure is accommodated in the outer packaging component. The food packaging body of the present disclosure can achieve accommodation of foods of different sizes and types in one packaging body and/or three-dimensional and patchwork food display at different levels in one packaging body and can seal a part of the cavities according to the requirements of different food.

19 Claims, 5 Drawing Sheets

(56) References Cited

U.S. PATENT DOCUMENTS

| | | | | | |
|---|---|---|---|---|---|
| 3,578,237 | A * | 5/1971 | Weiss | B65D 1/36 | 229/120.07 |
| 3,853,221 | A * | 12/1974 | Boyd | B65D 1/36 | 206/592 |
| 5,888,565 | A * | 3/1999 | Gics | B65D 77/0433 | 206/769 |
| 6,213,302 | B1 * | 4/2001 | Sanders | B65D 85/34 | 206/521.1 |
| D508,398 | S * | 8/2005 | Lee | D9/415 | |
| D915,475 | S * | 4/2021 | Wu | D15/90 | |
| 2004/0031799 | A1 | 2/2004 | Dege | | |
| 2004/0094043 | A1 * | 5/2004 | Morgan | A21C 11/00 | 99/426 |
| 2009/0200194 | A1 | 8/2009 | Kovacevich | | |
| 2011/0024321 | A1 | 2/2011 | Tilton | | |
| 2019/0135478 | A1 * | 5/2019 | Appendini | B65D 43/0212 | |

FOREIGN PATENT DOCUMENTS

| | | | | |
|---|---|---|---|---|
| EP | 0450213 | A1 | 10/1991 | |
| EP | 0475822 | A1 | 3/1992 | |
| EP | 1044897 | A1 | 10/2000 | |
| FR | 2860505 | A1 * | 4/2005 | B65D 1/36 |
| GB | 2199015 | A | 6/1988 | |
| GB | 2254306 | A | 10/1992 | |
| WO | 2008065807 | A1 | 6/2008 | |

* cited by examiner

FOOD PACKAGING BODY AND A COMBINATION PACKAGING BODY INCLUDING THE SAME

TECHNICAL FIELD

The present disclosure generally relates to a packaging body and a combination packaging body including the same, and more specifically to a food packaging body and a combination packaging body including the same.

BACKGROUND OF THE DISCLOSURE

Consumers usually like to obtain in one packaging body foods of different sizes and types (e.g., assorted chocolates, candies, cakes, crackers, dried fruits, other snack foods or pet foods in a variety of shapes and flavors). To ensure the quality of the packaged food and improve the market competitiveness, manufacturers pay the same attention to the production of the product itself and the packaging of the product. The factors that affect the quality of the product during transport and storage are not only health issues; a rise in the environment temperature can easily result in damage to the shape of the food and cause a loss of the taste of the food, and slight bumps during transport or carrying may also result in loss of the original good image of the food due to collisions and frictions between the food and the packaging wall. In particular, some upscale foods are often the first choice of presents for people, and matching packaging is important to ensure the quality of the product and to enhance the value of the product.

However, the property of each food differs, and the requirements for storage and transport are different. Prior art typically uses trays to accommodate food, and trays generally have downward recessed cavities of a uniform size, which is difficult to guarantee to provide effective protection to foods of various sizes and types. Even for foods having the same size, it is still monotonous and lacks aesthetic feelings when the foods are displayed on a plane using a tray with downward recessed cavities of a uniform size.

Therefore, for the existing food packaging bodies capable of accommodating different sizes and types of food in the art, there is an inability to meet the needs in multiple aspects such as food preservation, storage, transport, and aesthetics.

SUMMARY OF THE DISCLOSURE

In one aspect, the present disclosure provides a food packaging body including a tray and a lid located above the tray, and the tray has two or more downward recessed cavities, wherein the lid has upward protruding cavities which are less than the downward recessed cavities, and each of the upward protruding cavities is corresponding to the position of a downward recessed cavity.

In one aspect, the present disclosure provides a combination packaging body including an outer packaging component, wherein the food packaging body according to the present disclosure is accommodated in the outer packaging component.

In one aspect, the food packaging body of the present disclosure can achieve accommodation of foods of different sizes and types in one packaging body and/or three-dimensional and patchwork food display at different levels in one packaging body and can seal a part of the cavities according to the requirements of different foods.

Other aspects of the present disclosure are described elsewhere herein.

DETAILED DESCRIPTION OF THE DISCLOSURE

Figure 1:
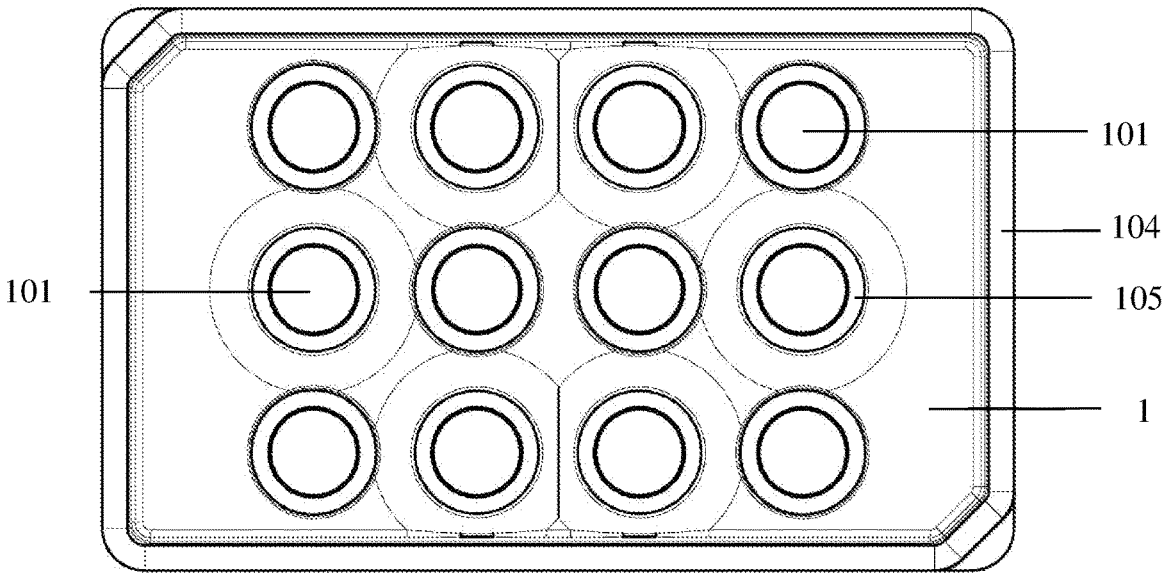
FIG. 1 is a main view of a tray of Example 1.
Figure 2:
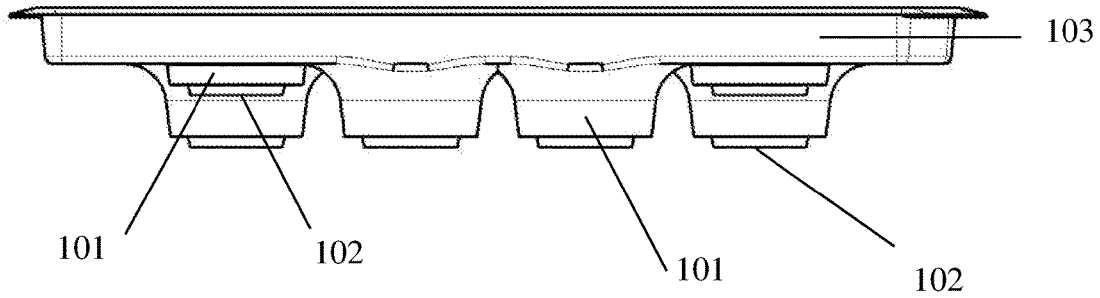
FIG. 2 is a bottom view of the tray of Example 1.
Figure 3:
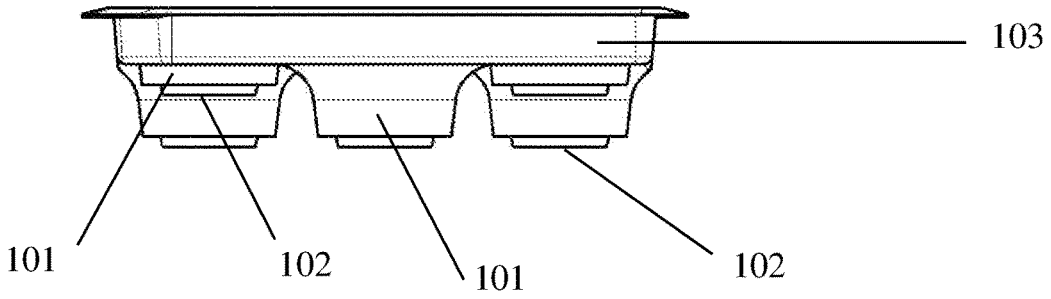
FIG. 3 is a left view of the tray of Example 1.
Figure 4:
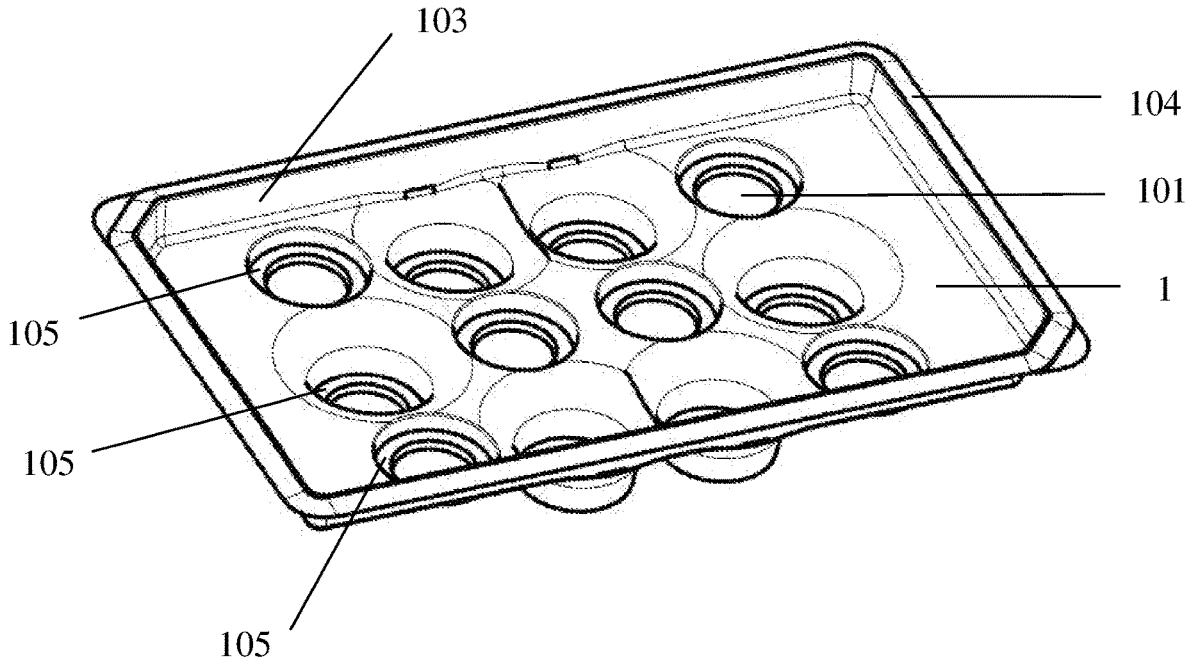
FIG. 4 is a perspective view of the tray of Example 1.

It is to be understood that the food packaging body of the present disclosure can be used for consumable foods of various shapes, dimensions, and textures. In one embodiment, non-restrictive examples of food accommodated in the food packaging body of the present disclosure include candies, cakes (especially cupcakes), crackers, dried fruits, chocolates (especially irregularly shaped chocolates), hard candies, gummy candies, mints, tablets, gum pellets, beads, liquid-filled beads, chewy candies, caramels, gumballs, muffins, puffs, macarons, donuts, cookies, moon cakes, Sachima, egg tarts, crispy balls, peanuts, nuts, pretzels, and pet food or treats, etc.

In one example, the present disclosure provides a food packaging body including a tray and a lid located above the tray, and the tray has two or more downward recessed cavities, wherein the lid has upward protruding cavities which are less than the downward recessed cavities, and each of the upward protruding cavities is corresponding to the position of a downward recessed cavity.

In one example, the upward protruding cavities are less than the downward recessed cavities, which can a flexible adjustment of foods of different sizes accommodated in the same tray. For example, food of a larger size can be accommodated in a downward recessed cavity having an upward protruding cavity corresponding thereto on the lid. Even for foods of the same size, patchwork food display at different positions and heights on a plane with aesthetic feelings can be realized by adjusting the depth of the downward recessed cavities on the tray and/or the depth of the upward protruding cavities. In addition, a part of the cavities can be sealed according to the requirements of different foods.

According to a preferable specific embodiment of the present disclosure, the tray is made of a polyester material. In one example the distribution of the cavities of the tray and the lid is preferably based on the design style, and the distribution is uniform and beautiful. The number of the downward recessed cavities is preferably 4 to 50, more preferably 4 to 20, and most preferably 8 to 12. The upward protruding cavities may be less than the downward recessed cavities, and the number of the upward protruding cavities is preferably 4 to 28, more preferably 4 to 16, and most preferably 6 to 10. In one example the downward recessed cavities are divided into two categories: (A) downward recessed cavities that do not have upward protruding cavities corresponding thereto on the lid, and (B) downward recessed cavities that have upward protruding cavities corresponding thereto on the lid; the depth of the downward recessed cavities of the (A) category is larger than the depth of the downward recessed cavities of the (B) category.

In one example the tray of the present disclosure can be placed stably on a plane. In one example, among all downward recessed cavities of the tray, the bottom of the downward recessed cavity having the largest depth is a plane, so that the tray is stably placed on the plane: or the bottoms of at least three of the downward recessed cavities are on the same plane, so that the tray is stably placed on the plane.

The tray and the lid of the present disclosure may be fitted to each other to be fixed to each other, and thus the cavities formed by the tray and the lid may also be stabilized. The fitting method is, for example, engaging, riveting, bonding, stitching, etc. In one example, the tray has a wall extending upward along the edge of the tray, and the wall of the lid and the wall of the tray are fitted to each other. In one example, the lid has a wall that extends upward along the edge of the lid, the extending direction of the wall of the lid is consistent with the upward protruding direction of the cavities of the lid, and the lid and the tray are engaged with each other through the walls of the lid and the tray.

In one example the fitting of the tray and the lid further includes that the wall of the lid that extends upward is partially in contact with the wall of the tray that extends upward, so that a consumer can remove the lid through a gap in the non-contact part.

In one example, the top surfaces of the upward protruding cavities of the lid and the top end of the wall of the tray that extends upward are on the same plane, or the top surfaces of the upward protruding cavities of the lid are lower than the top end of the wall of the tray that extends upward. In this way, it is convenient to add other packages (especially packaging bags) to the food packaging body of the present disclosure, and it is advantageous to stack a plurality of the food packaging bodies of the present disclosure.

In one example the cross-sectional shapes of the upward protruding cavities and the downward recessed cavities are symmetrical geometric shapes or irregular geometric shapes. In one example, the cross-sectional shapes of the upward protruding cavities and the downward recessed cavities are round, oval, triangular, prismatic, rectangular, pentagonal, hexagonal, fan-shaped, star-shaped, or heart-shaped. In one example the cross-sectional shapes of the upward protruding cavities and the downward recessed cavities are consistent. In one example, the upward protruding cavity is a truncated cone or a hemisphere, particularly similar to a reverted deep pan, and is particularly suitable for accommodating domed chocolate and cup-like chocolate.

In one example, two or more downward recessed cavities of the tray differ in the size and/or the cross-sectional shape. In one example, the cross-sectional shapes of the upward protruding cavities and the downward recessed cavities are the same or different: the cross-sectional shapes and areas at different positions of each of the upward protruding cavities or the downward recessed cavities are the same or different; and the cross-sectional shapes and areas of the upward protruding cavities and the downward recessed cavities are the same at a position where the protruding cavities are in contact with the downward recessed cavities. In one example, the cross-sectional shapes of the upward protruding cavities and the downward recessed cavities are different. In one example, the cross-sectional shapes and areas at different positions of each of the upward protruding cavities or the downward recessed cavities are different.

In one example, at least one of the downward recessed cavities has a stage, and/or at least one of the upward protruding cavities has a stage. It is not necessary that each of the cavities must have a stage. In some embodiments, the cavity can have a stage or have no stage, and in other embodiments, each cavity can have only one stage or have a plurality of stages.

In certain embodiments, in the downward recessed cavities having stages or the upward protruding cavities having stages, the number of the stages is greater than one. The stages greater than one can play a fixing role, and the combination of different stages can realize accommodation of foods of different types and/or shapes in the same cavity, and the foods are fixed by different stages. That is, the plurality of stages enables the cavities to hold and support at least two foods of different sizes and/or shapes, such as irregularly shaped chocolate blocks and candy blocks. In one example the same cavity can be used to accommodate three or more foods of different sizes and/or shapes, respectively. Some cavities can accommodate two or more different shapes of food, and some other cavities can accommodate two or more shapes of food.

In one example, in the downward recessed cavities having stages or the upward protruding cavities having stages, the length of the stage is less than the circumference of the cross section of the downward recessed cavities or the upward protruding cavities. The stage may include one or more protrusions and/or pits, such as a step or a shoulder portion, and the cross-sectional shapes of the protrusions and/or pits are symmetrical geometric shapes or irregular geometric shapes. In one example, the cross-sectional shapes of the protrusions and/or pits are round, oval, triangular, prismatic, rectangular, pentagonal, hexagonal, fan-shaped, star-shaped, heart-shaped, or hollow rings thereof.

In one example, the stage is a concentric shoulder portion surrounding the entire downward recessed cavity or the upward protruding cavity, an upward protruding portion at the bottom of the downward recessed cavity, a downward protruding portion at the top of the upward protruding cavity, or one or more cross rods in the downward recessed cavity or the upward protruding cavity.

The stages of the downward recessed cavities and/or the upward protruding cavities may be the same or different, and in one example, the stages of the downward recessed cavities and/or the upward protruding cavities are different. The number and shape of the stages in the cavities can be determined according to different forces the food receives in the cavities.

In one example, the packaging body further includes a pad card which is located above the lid or between the tray and the lid. The pattern of the pad card can be changed quickly according to different concepts. That is, the pad card can be changed with various themes and scenarios, for example, themes of different holidays (Christmas, Valentine's Day, Mid-Autumn Festival, Spring Festival), which can bring more targeted personalized choices to the consumers without changing the main structure of the present disclosure. The pad card can also be a trademark card.

The pad card may have a hole, and the position of the hole may correspond to an upward protruding cavity of the lid. Some foods need to be kept strictly away from light while some foods do not need to be kept away from light, and the hole in the pad card can meet the requirement of avoiding light for different areas. In addition, the double-layered structure formed by the tray and the lid may hide some foods under the lid, and thus the promotion area is widened by matching the pad card. This can display the sealed tray having a dense layout.

The lid may be at least partially transparent, and at least one food (e.g., a candy block, a chocolate block, etc.) in the tray may be seen through the lid. In one example the lid is transparent, which is advantageous in displaying the food or observing the state of the food. Moreover, the appearance of the food itself can also make a beautiful visual experience with the pattern on the pad card. Some foods need to be kept strictly away from light while some foods do not need to be kept away from light, and the hole in the pad card can meet the requirement of avoiding light for different areas. That is, the pad card having holes cannot only constitute a scenario of food consumption alone, but also can form a full picture to the consumer with the food displayed through the transparent lid portion.

The food packaging body of the present disclosure may be sold directly as a final packaging product (product information is printed on the sealing film or pad card), and may also be sold as an internal package, and may be sold after one or more of the packaging bodies are placed in an outer packaging component having a compatible overall shape.

In one example the present disclosure also provides a combination packaging body including an outer packaging component, wherein the food packaging body of the present disclosure is accommodated in the outer packaging component. The outer packaging component may be selected from a group consisting of a packaging box, a packaging bag, a packaging film, and a combination thereof. The packing box, the packaging bag, and the packaging film may have a shape substantially corresponding to the shape of the food packaging body accommodated therein.

The outer packaging component may accommodate at least two of the food packaging bodies of the present disclosure, and at least one food packaging body may be different from the other food packaging bodies, or in one example all the food packaging bodies may be different from each other.

The object, structural features, and advantages of the present disclosure will be further described in detail below with reference to specific examples and the attached drawings. The following examples are only illustrative and are intended to better describe the present disclosure and are not intended to limit the scope of protection.

Example 1

FIG. 1 to FIG. 9 are schematic views of a food packaging body of a specific example of the present disclosure, and the food packaging body of the present example mainly includes a tray 1 and a lid 2, and preferably includes a pad card 3.

Figure 9:
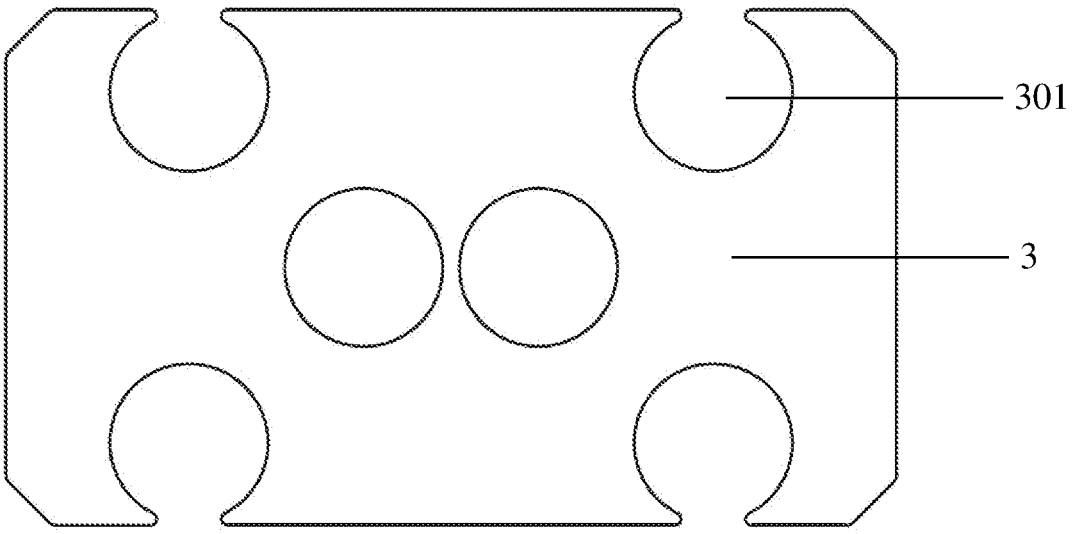
FIG. 9 is a main view of a pad card of Example 1.

Specifically, FIG. 1 to FIG. 4 are respectively a main view, a bottom view, a left view, and a perspective view of the tray of Example 1. FIG. 5 to FIG. 8 are respectively a main view, a bottom view, a left view, and a perspective view of the lid of Example 1. FIG. 9 is a main view of a pad card of Example 1.

It can be seen from FIGS. 1 to 4 that the rectangular tray 1 has 12 downward recessed cavities 101, and six of them are shallowly downward recessed cavities while the other six are deeply downward recessed cavities. The bottoms 102 of the deeply downward recessed cavities are plane and are on the same plane, thereby ensuring that the tray 1 can be stably placed on the plane.

Figure 5:
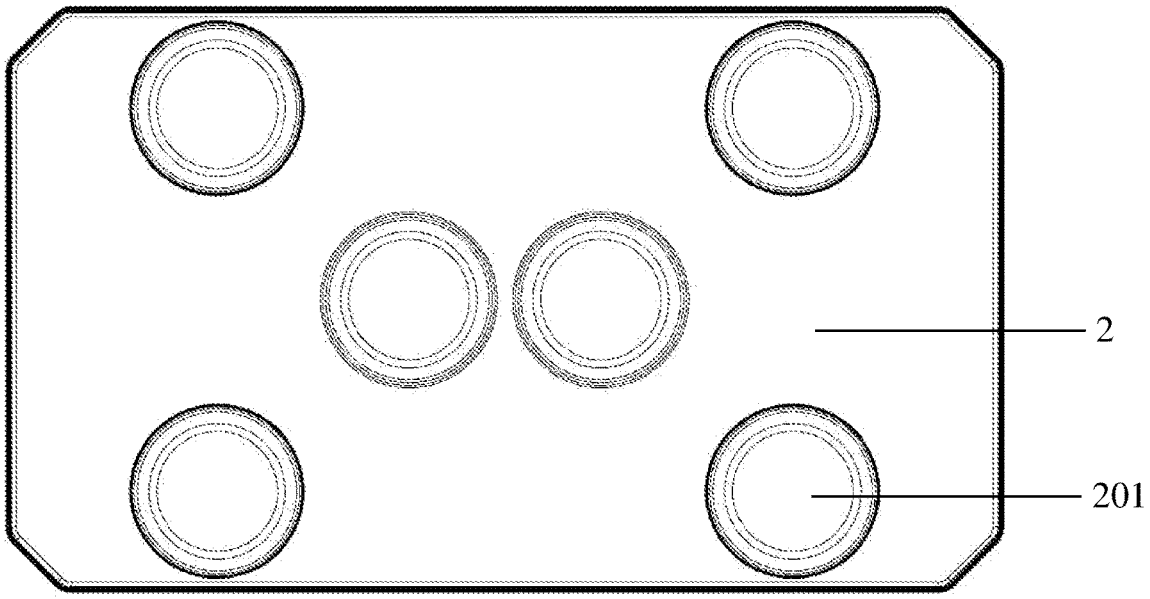
FIG. 5 is a main view of a lid of Example 1.
Figure 6:
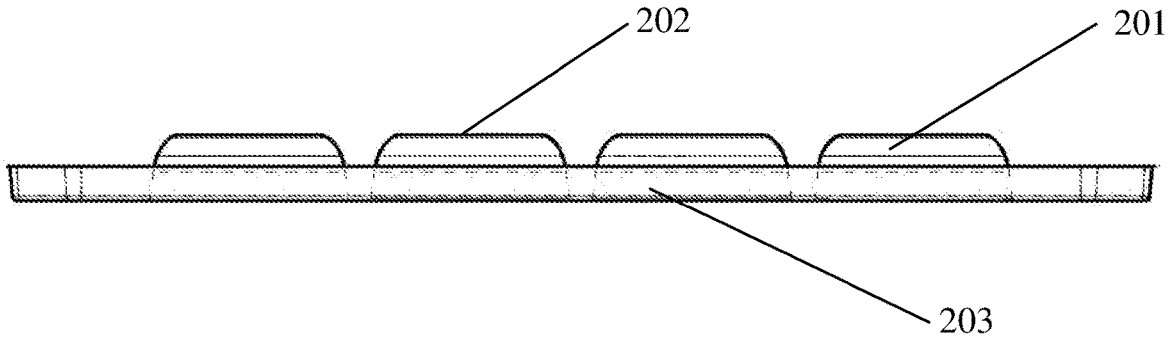
FIG. 6 is a top view of the lid of Example 1.
Figure 7:
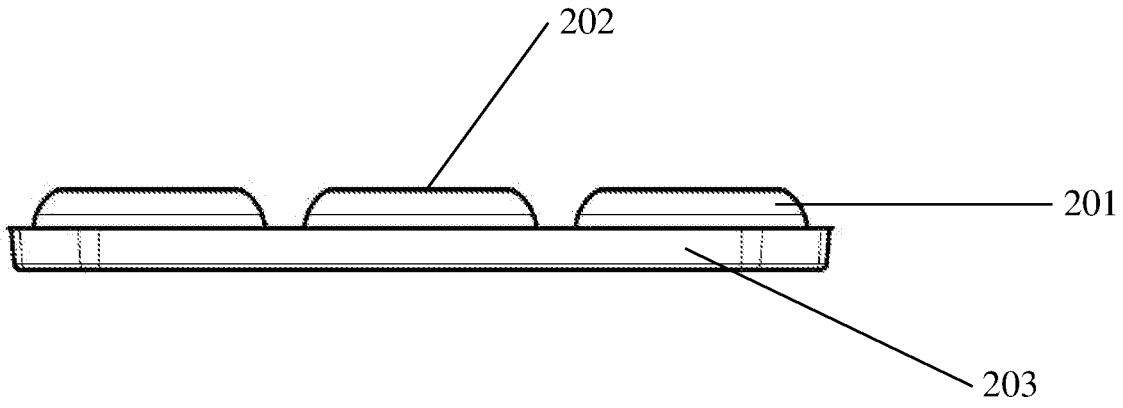
FIG. 7 is a left view of the lid of Example 1.
Figure 8:
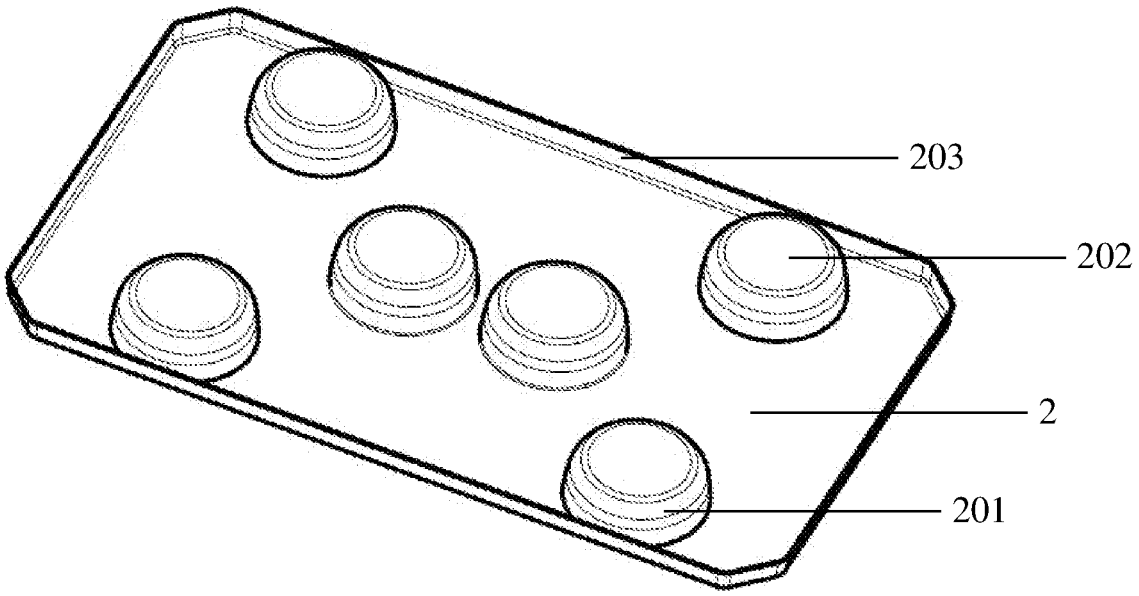
FIG. 8 is a perspective view of the lid of Example 1.

It can be seen from FIG. 5 to FIG. 7 that the lid 2 has six upward protruding cavities 201, and each of the upward protruding cavities 201 is corresponding to the six shallowly downward recessed cavities 101 respectively, thereby forming six big cavities. This allows a display of food having a large size, and finally achieve accommodation of foods of different sizes and types in one packaging body and/or three-dimensional and patchwork food display at different levels in one packaging body. The cross-sectional shapes at different positions of each of the upward protruding cavities 201 or the downward recessed cavities 101 are the same (round), and the areas at different positions of each of the upward protruding cavities 201 or the downward recessed cavities 101 are different; and the cross-sectional shapes and areas of the upward protruding cavities 201 and the downward recessed cavities 101 are the same at a position where the protruding cavities are in contact with the downward recessed cavities.

The tray 1 has a wall 103 that extends upward along the edge of the tray, and a top end 104 of the wall that extends upward along the edge of the tray is higher than a top surface 202 of the upward protruding cavities of the lid 2, thereby facilitating the use of an outer packaging component for the food packaging body of Example 1. The lid 2 has a wall 203 extending upward along the edge of the lid. The extending direction of the wall 203 of the lid is consistent with the upward protruding direction of the cavities 201 of the lid, and the lid 2 and the tray 1 are engaged with each other through the wall 103 that extends upward along the edge of the tray and the wall 104 that extends upward along the edge of the lid, which can play a fixing role to the food accommodated in the tray 1 and avoid displacement of the tray 1 and the lid 2. All the downward recessed cavities have a stage 105, which can be used to assist in fixing and supporting food in the tray. The wall 203 of the lid that extends upward is partially in contact with the wall 103 of the tray that extends upward, so that a consumer can remove the lid through a gap in the non-contact part.

As can be seen from FIG. 9, the pad card 3 has six holes 301 that correspond to the upward protruding cavities 201 of the lid. For the consideration of food safety, it is preferable that the pad card 3 is located above the lid 2. The food producer can change the pad card 3 with different themes or scenarios for different holidays without changing the structures of the tray 1 and the lid 2, which is advantageous in attracting consumers and reducing the packaging costs.

Example 2 to 10

| Example | Number of downward recessed cavities 101/number of downward recessed cavities 101 having stages | Cross-sectional shape of downward recessed cavities 101 | Number of upward protruding cavities 201/number of upward protruding cavities 201 having stages | Cross-sectional shape of upward protruding cavities 201 | Number of downward recessed cavities 101/number of stages of each upward protruding cavity 201 | Cross-sectional shape of downward recessed cavities 101/cross-sectional shape of stages of each upward protruding cavity 201 |
|---|---|---|---|---|---|---|
| Example 2 | 12/6 | Round | 6/0 | Round | 1/0 | Ring-shaped/— |
| Example 3 | 16/8 | Oval | 12/4 | Oval | 2/1 | Oval hollow ring/Oval hollow ring |
| Example 4 | 20/12 | Rectangular | 10/4 | Rectangular | 1/2 | Round/ring-shaped |
| Example 5 | 8/0 | Heart-shaped | 4/0 | Fan-shaped | 0/0 | —/— |
| Example 6 | 12/0 | Star-shaped | 8/0 | Star-shaped | 0/0 | —/— |
| Example 7 | 9/3 | Pentagonal | 5/2 | Pentagonal | 1/1 | Pentagonal hollow ring/pentagonal hollow ring |

-continued

| Example | Number of downward recessed cavities 101/number of downward recessed cavities 101 having stages | Cross-sectional shape of downward recessed cavities 101 | Number of upward protruding cavities 201/number of upward protruding cavities 201 having stages | Cross-sectional shape of upward protruding cavities 201 | Number of downward recessed cavities 101/number of stages of each upward protruding cavity 201 | Cross-sectional shape of downward recessed cavities 101/cross-sectional shape of stages of each upward protruding cavity 201 |
|---|---|---|---|---|---|---|
| Example 8 | 18/0 | Hexagonal | 9/9 | Hexagonal | 0/1 | —/hexagonal hollow rings |
| Example 9 | 25/20 | Triangular | 16/— | Triangular | 1/0 | Ring-shaped/— |
| Example 10 | 36/10 | Prismatic | 20/8 | Prismatic | 1/1 | Rectangular/rectangular hollow ring |

Although specific features of various embodiments of the present disclosure can be shown in some of the attached drawings and not in other attached drawings, this is for convenience only. In addition, references to "one embodiment" in the above description are not intended to be construed as excluding the existence of an additional embodiment that also includes the described features. According to the principles of the present disclosure, any feature in one of the attached drawings may be referenced and/or claimed for protection in combination with any feature in any other attached drawings.

Although some exemplary embodiments have been described and illustrated in the attached drawings, it is to be understood that such embodiments are merely descriptive of the broadly publicized content and are not restrictive, and the present disclosure is not limited to the specific structures and arrangements that have been shown and described, as various other modifications can be made by those of ordinary skills in the art.

What is claimed is:

1. A food packaging body including:

a tray including two or more downward recessed cavities and having a wall that extends upward along an edge of the tray; and a lid located above the tray and including one or more upward protruding cavities, wherein a number of the one or more upward protruding cavities is less than a number of the two or more downward recessed cavities, each of the one or more upward protruding cavities is corresponding to a position of a respective one of the two or more downward recessed cavities, and a top surface of each of the one or more upward protruding cavities is on a same plane as or is lower than a top end of the wall of the tray, wherein the one or more upward protruding cavities upwardly protrude from an exterior facing surface of the lid past a top end of a wall of the lid, the exterior facing surface of the lid being opposite to an interior facing surface of the lid configured to contact the tray;

wherein a first cavity from the two or more downward recessed cavities or the one or more upward protruding cavities has a first stage of a first shape and a first size, a second cavity from the two or more downward recessed cavities or the one or more upward protruding cavities has a second stage of a second shape and a second size, and at least one of the first shape or the first size of the first stage is different than the second shape or the second size of the second stage; and wherein at least one cavity of the two or more downward recessed cavities or the one or more upward protruding cavities has a plurality of stages.

2. The food packaging body according to claim 1, wherein the two or more downward recessed cavities are divided into two categories: a first category including one or more downward recessed cavities that each do not have one of the one or more upward protruding cavities corresponding thereto on the lid, and a second category including one or more downward recessed cavities that each have one of the one or more upward protruding cavities corresponding thereto on the lid; and wherein a depth of the one or more downward recessed cavities of the first category is larger than a depth of the one or more downward recessed cavities of the second category.

3. The food packaging body according to claim 1, wherein a bottom of one of the two or more downward recessed cavities having a largest depth is a plane, so that the tray is stably placed on the plane; or wherein the tray includes three or more downward recessed cavities, and bottoms of at least three of the three or more downward recessed cavities are on the same plane, so that the tray is stably placed on the plane.

4. The food packaging body according to claim 1, wherein the wall of the lid extends upward along the edge of the lid, and the wall of the lid and the wall of the tray are fitted to each other.

5. The food packaging body according to claim 4, wherein a direction that the wall of the lid extends upward is consistent with an upward protruding direction of the one or more upward protruding cavities of the lid, and the lid and the tray are engaged with each other through the wall of the lid and the wall of the tray.

6. The food packaging body according to claim 5, wherein the wall of the lid that extends upward is partially in contact with the wall of the tray that extends upward, and the lid is removable from the tray through a gap in a non-contact part.

7. The food packaging body according to claim 1, wherein cross-sectional shapes of the one or more upward protruding cavities and the two or more downward recessed cavities are symmetrical geometric shapes or irregular geometric shapes, and the cross-sectional shapes are round, oval, triangular, prismatic, rectangular, pentagonal, hexagonal, fan-shaped, star-shaped, or heart-shaped.

8. The food packaging body according to claim 1, wherein at least two of the two or more downward recessed cavities of the tray differ in size, cross-sectional shape, or both size and cross-sectional shape.

9. The food packaging body according to claim 1, wherein cross-sectional shapes of the one or more upward protruding cavities and the two or more downward recessed cavities are the same or different; the cross-sectional shapes and areas at different positions of each of the one or more upward protruding cavities or the two or more downward recessed cavities are the same or different; and the cross-sectional shapes and areas of the one or more upward protruding cavities and the respective one or more of the two or more downward recessed cavities to which the one or more upward protruding cavities correspond are the same at a position where the one or more upward protruding cavities are in contact with the respective one or more of the two or more downward recessed cavities.

10. The food packaging body according to claim 1, wherein each cavity of the two or more downward recessed cavities or the one or more upward protruding cavities has a stage.

11. The food packaging body according to claim 1, wherein a length of a stage included in at least one cavity of the two or more downward recessed cavities or the one or more upward protruding cavities is less than a circumference of a cross section of the at least one cavity.

12. The food packaging body according to claim 1, wherein a stage included in at least one cavity of the two or more downward recessed cavities or the one or more upward protruding cavities includes one or more protrusions, one or more pits, or a combination of the one or more protrusions and the one or more pits, cross-sectional shapes of the one or more protrusions or the one or more pits are symmetrical geometric shapes or irregular geometric shapes, and the cross-sectional shapes of the one or more protrusions or the one or more pits are round, oval, triangular, prismatic, rectangular, pentagonal, hexagonal, fan-shaped, star-shaped, heart-shaped, or hollow rings thereof.

13. The food packaging body according to claim 1, wherein a stage included in at least one cavity of the two or more downward recessed cavities or the one or more upward protruding cavities is a concentric shoulder portion surrounding an entirety of the at least one cavity, an upward protruding portion at a bottom of the at least one cavity when the at least one cavity is one of the two or more downward recessed cavities, a downward protruding portion at a top of the at least one cavity when the at least one cavity is one of the one or more upward protruding cavities, or one or more cross rods in the at least one cavity.

14. The food packaging body according to claim 1, wherein, for the at least one cavity of the two or more downward recessed cavities or the one or more upward protruding cavities having the plurality of stages, each of the plurality of stages of the at least one cavity is of a different stage type.

15. The food packaging body according to claim 1, wherein the food packaging body further includes a pad card located above the lid or between the tray and the lid.

16. The food packaging body according to claim 15, wherein the pad card has a hole, and a position of the hole corresponds to one of the one or more upward protruding cavities of the lid.

17. The food packaging body according to claim 1, wherein the lid is transparent.

18. The food packaging body according to claim 1, wherein at least one of the one or more upward protruding cavities has a stage, and wherein one of the two or more downward recessed cavities to which the at least one of the one or more upward protruding cavities corresponds has a stage.

19. The food packaging body according to claim 1, wherein the wall of the lid extends upward along the edge of the lid, the edge being an outermost edge of the lid, and the food packaging body further includes a pad card located above the lid and confined by the wall of the lid.

* * * * *